US005904046A

United States Patent [19]

Kawano

[11] Patent Number: 5,904,046

[45] Date of Patent: May 18, 1999

[54] PULSE TUBE REFRIGERATING SYSTEM

[75] Inventor: Shin Kawano, Kariya, Japan

[73] Assignee: Aisin Seiki Kabushiki Kaisha, Kariya, Japan

[21] Appl. No.: 08/975,209

[22] Filed: Nov. 20, 1997

[30] Foreign Application Priority Data

Nov. 20, 1996 [JP] Japan ..... 8-309708

[51] Int. Cl.[6] ..... F25B 9/00

[52] U.S. Cl. ..... 62/6; 60/620

[58] Field of Search ..... 62/6; 60/520

[56] References Cited

U.S. PATENT DOCUMENTS

| | | | |
|---|---|---|---|
| 5,295,355 | 3/1994 | Zhou et al. | 62/6 |
| 5,412,952 | 5/1995 | Ohtani et al. | 62/6 |
| 5,720,172 | 2/1998 | Ishizaki | 62/6 |

OTHER PUBLICATIONS

A Review of Pulse Tube Refrigeration, Ray Radebaugh, Advances in Cryogenic Engineering, vol. 35, 1990, pp. 1191–1205.

Alternative Methods of the Orifice Pulse Tube Refrigerator, Y. Matsubara and A. Miyake, The 5$^{th}$ International Cryocooler Conference, pp. 127–135.

*Primary Examiner*—Ronald Capossela

*Attorney, Agent, or Firm*—Oblon, Spivak, McClelland, Maier & Neustadt, P.C.

[57] ABSTRACT

A pulse tube refrigeration system includes a pressure wave generator generating continuous pressure wave of a working fluid: a regenerator having a low temperature end and a high temperature end connected to the pressure wave generator; a cold head connected at one end thereof to the low temperature end of the regenerator and producing a very low temperature; a pulse tube having a high temperature end and a low temperature end connected to the other end of the cold head; and a phase shifter adjusting a phase difference between a pressure oscillation and a displacement of the working fluid and transmitting an expansion work of the working fluid to the high temperature end of the regenerator in mechanical mode which is performed at the high temperature end of the pulse tube.

12 Claims, 2 Drawing Sheets

PULSE TUBE REFRIGERATING SYSTEM

BACKGROUND OF THE INVENTION

1. Field of the Invention

The present invention relates to a pulse tube refrigerating system which serves for generating very low temperatures and in particular to an efficiency-improved system of such a type.

2. Discussion of Background

As is well-known, a conventional pulse tube refrigerating system is constructed such that a pressure wave generator, a regenerator, a cold head and a pulse tube are connected in series in this order. Between the pressure wave generator and the pulse tube, there is formed a closed operating space which is filled with a working fluid such as helium gas. When the pressure wave generator is turned on, an alternating mass flow of the working fluid is caused, which results in an establishment of a phase difference between pressure oscillation and displacement of the working fluid. This leads to that in the regenerator a heat flow is generated from a cold head to the pressure wave generator and the cold head is cooled down to a very low temperature.

In order to obtain the maximum cooling ability or heat transfer ability at the cold head, it is well known that setting the phase difference at about 90 degrees is effective. This fact can be known from a thesis, for example, reported in Advances in Cryogenic Engineering, Vol. 35, P1191/1990). On the basis of this, an improved pulse tube refrigerating system has been proposed in a report (Proceedings of the fifth International Cryocooler conference P127/1988). In the improved system, a phase shifter is employed in order to establish a suitable phase difference of about 90 degrees between pressure oscillation and displacement of the working fluid.

As shown in FIG. 3, a conventional pulse tube refrigerating system 103, which is equivalent to the foregoing improved pulse tube refrigerating system, includes a pressure wave generator 1, a regenerator 2, cold head 3, and a pulse tube 4 which are connected in series in this order. The pulse tube has a high temperature end 44 which is in connection with an expansion piston system 6. The expansion piston system 6 includes a cylinder 61, a piston 62 reciprocally fitted in the cylinder 61, a spring 58, a wire coil 59 wound around the cylinder 61, and a resistor (not shown) connected to the wire coil 59 in series. In the cylinder 61, there are formed a space 63 and a space 64 at opposite ends of the piston 62. The spring 58 serves for supporting the piston 62 and is connected at its upper end to the cylinder 61 and at its lower end to a back end of the piston 62. A clearance seal is constructed between an axial outer surface of the piston 62 and an inner end wall of the cylinder 61.

The piston 62 is in the form of a permanent magnet and establishes an electromagnetic induction system by cooperating with the coil 59. The expansion piston system 6 has an eigenfrequency which depends on a mass of the piston 62, a spring constant of the spring 58 and a gas spring constant of the space 64. Induction currents created while the piston 62 is reciprocated are supplied to the resistor and an amount of heat is generated at the resistor. The resulting heat is rejected or radiated, as Joule heat, to the surroundings. Due to such a heat generation, a damping force is applied to the piston 62. In addition, a compulsory force is applied to piston 62, whose magnitude is a multiplication of a cross-section area of the piston 62 and a pressure difference between the space 63 and 64. Thus, the expansion piston system 6 is constituted as a damped and compulsory force system.

In the expansion piston system 6, if the eigenfrequency thereof is in coincidence with the operating frequency of the pressure wave generator 1, when the piston 62 under movement away from the high temperature end 44 of the pulse tube 4 passes through the center point of the oscillation of the piston 62, the speed of the piston 62 takes its maximum value and the absolute value of current induced at the wire coil 59 becomes maximum. Thus, the compulsory force applied to the piston 62 becomes maximum which is obtained by subtracting the pressure in the space 64 from the pressure in the space 63. This means that the maximum setting efficiency of the system 6 is established by setting a phase difference of 90 degrees between the maximum pressure in the space 63 and the farthest position of the piston 62 relative to the high temperature end 44 of the pulse tube 4. On the other hand, due to the volume of the pulse tube 4, at a low temperature end 43 of the pulse tube 4 the phase difference at the low temperature end 43 of the pulse tube 4 is less than the foregoing phase difference of 90 degrees by tens of degrees.

In light of this, in the expansion piston system 6, the eigenfrequency thereof is set to be less than the operating oscillation frequency of the pressure wave generator 1 in order to maximize the compulsory force applied to the expansion piston 62, which is defined by the subtraction of the pressure in the space 64 from the pressure in the space 63, before the piston 62 passes through the center of oscillation thereof This means that a phase difference of above 90 degrees is set between a time when the pressure in the space 63 becomes maximum and a subsequent time when the piston 62 takes the farthest position relative to the high temperature end 44 of the pulse tube 4. This establishes a substantial 90 degrees in phase difference at the low temperature end 43 of the pulse tube 4, resulting in an improvement of producing very low temperature or cold at the cold head 3.

However, in the foregoing pulse tube refrigeration system 103, an amount of expansion work performed by the expansion piston system 6 is rejected to the surrounding as a heat, which brings that an amount of compression work to be done at the pressure wave generator 1 becomes large and an efficiency of producing very low temperature is not better than expected. The following is an analysis of such a phenomena. Approximately, the work Wexp which is rejected to the surroundings from the system 6 can be represented as the following equation.

$$W\text{exp}=\pi A\ P_o\xi_o \sin\Theta$$

where A is a cross-section area of the expansion piston 62, $P_o$ is an amplitude of the pressure oscillation in the space 63, $\xi_o$ is an amplitude of the displacement of the expansion piston 62, $\Theta$ is the phase difference between the maximum pressure in the space 63 and the farthest position of the expansion piston 62 relative to the high temperature end 44 of the pulse tube 4 when the piston 62 is under movement away from the high temperature end 44 of the pulse tube 4.

On the other hand, the Wcomp which is done by the pressure wave generator 1 can be represented as the following formula or equation.

$$W\text{comp}=W\text{p}+(T\text{H}/T\text{c})W\text{exp}$$

where Wp is a work loss which is done as a result of pressure drop at the regenerator 2, TH is a radiating temperature at the pressure wave generator 1, TC is a temperature produced at the cold head 3.

A ratio of Wexp/Wcomp is given as follows.

$$Wexp/Wcomp=(1-Wp/Wcomp)TH/TC.$$

As an example, substituting 0.2, 80K, and 320K for Wp/Wcomp, TH, and TC, respectively, the ratio of Wexp/Wcomp becomes 0.2. This means that 20 percent of the work performed at the pressure wave generator 1 is rejected at the expansion piston system 6 to the surroundings as a heat. In addition, if the value of TC is approximately the same as the value of TH, the ratio of Wexp/Wcomp approaches 1, which indicates that most of the work performed at the pressure wave generator 1 is rejected at the expansion piston system 6 to the surroundings as a heat.

SUMMARY OF THE INVENTION

It is, therefore, a principal object of the present invention is to provide a pulse tube refrigeration system without such drawbacks.

Another object of the present invention is to provide a pulse tube refrigeration system in which at an expansion piston system, acting a phase shifter, an as-possible minimum rejection of work is established.

In order to attain the foregoing objects, a pulse tube refrigeration system includes a pressure wave generator generating continuous pressure wave of a working fluid; a regenerator having a low temperature end and a high temperature end connected to the pressure wave generator; a cold head connected at one end thereof to the low temperature end of the regenerator and producing a very low temperature; a pulse tube having a high temperature end and a low temperature end connected to the other end of the cold head; and a phase shifter adjusting a phase difference between a pressure oscillation and a displacement of the working fluid and transmitting an expansion work of the working fluid to the high temperature end of the regenerator in mechanical mode which is performed at the high temperature end of the pulse tube.

In brief, in the pulse tube refrigeration system according to the present invention, the work of the working fluid which is performed at the high temperature end of the pulse tube is expected to be transmitted with little loss to the high temperature end of the regenerator and the resultant work serves as a part of a work to be done by the pressure wave generator. Thus, with remaining an expected producing ability or efficiency of very low temperatures, an increase of the work to be done by the pressure wave generator can be achieved.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF PREFERRED EMBODIMENT

Preferred embodiments of the present invention will be described hereinafter in detail with reference to the accompanying drawings.

Figure 1:
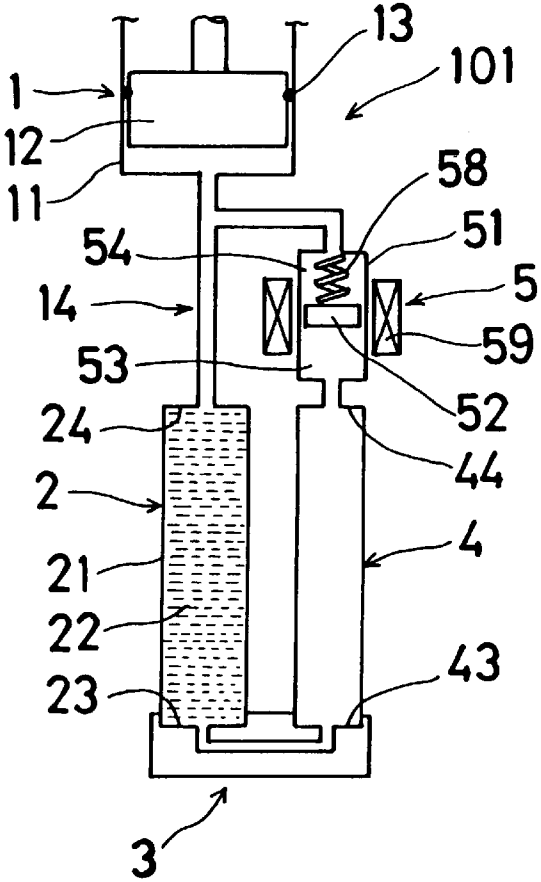
FIG. 1 is a diagram of a first embodiment of a pulse tube refrigeration system according to the present invention.
Figure 3:
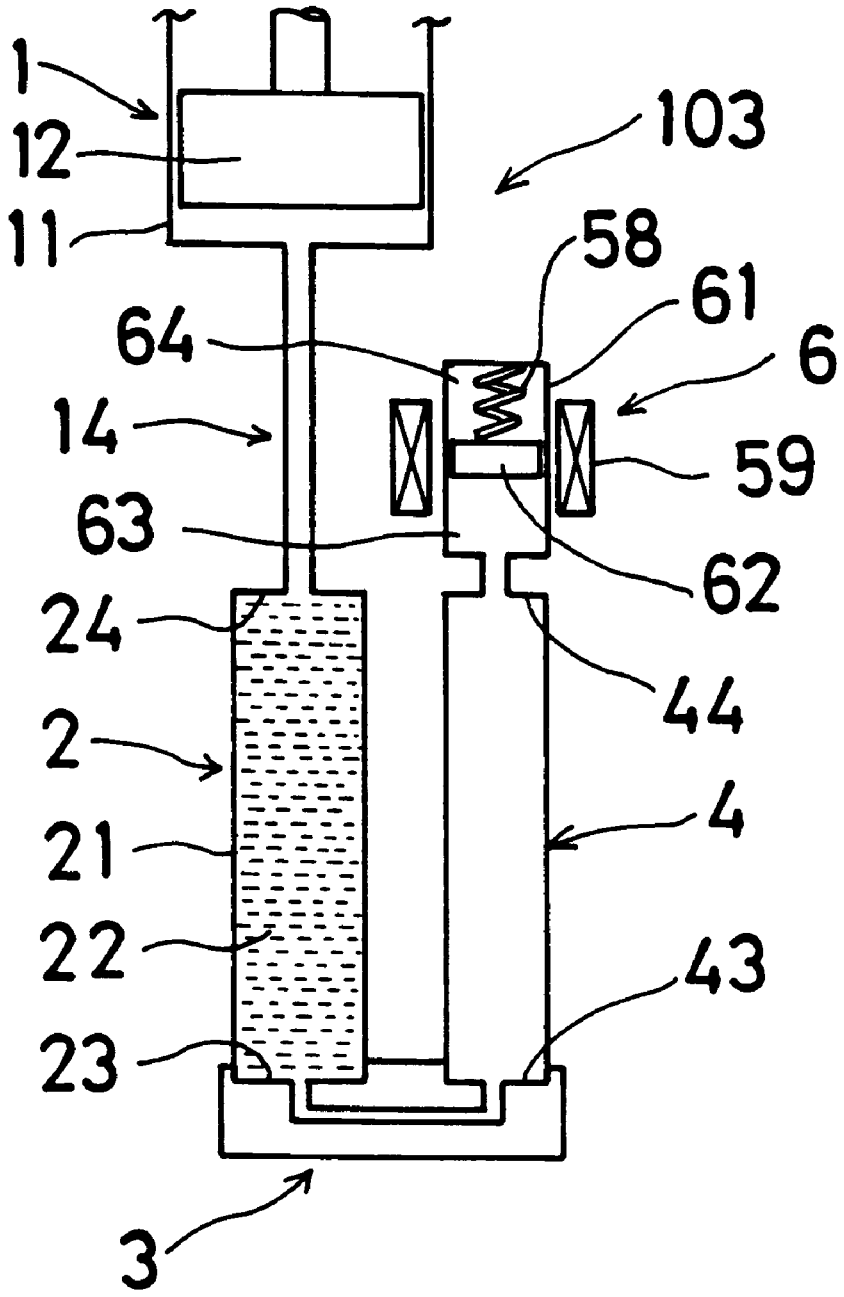
Fig. 3 (Prior art)
FIG. 3 is a diagram of a conventional pulse tube refrigeration system.

Referring to FIG. 1 which depicts a pulse tube refrigeration system 101 according to a first embodiment of the present invention, the system 101 includes a pressure wave generator 1 which generates a continuous pressure wave, a regenerator 2, a cold head 3, and a pulse tube which are connected or arranged in series in this order. Between the pressure wave generator 1 and the regenerator 2, there is formed a connecting portion or tube 14 which is connected to a high temperature end 44 of the pulse tube 4 via a displacer system 5. Such arrangements constitute a closed operating space in which an amount of working fluid is filled. As the working fluid, helium gas, neon gas, argon gas, nitrogen gas, air in gas phase, and a mixture of any two or more of the foregoing gases are available.

The pressure wave generator 1 includes a cylinder 11, a piston 12 reciprocally fitted within the cylinder 11, a driving source (not shown) for driving the piston 12, a supporting means (not shown) for establishing a clearance seal between a outer end surface of the piston 12 and an inner end surface of the cylinder 11. The regenerator 2 includes a cup 22 which is made of a metal such as a stainless steel which is of a poor or small thermal conductivity. Within the cup 22, there is accommodated a cold retaining member or element which is in the form of stacked metal made-mesh plates which are made of stainless steel, phosphor bronze or the like. The cold head 3 is made of a metal such a copper which is of a good or large thermal conductivity. The pulse tube 4 is formed in a hollow cylindrical configuration and is made of a metal such as a stainless steel which is of a poor or small thermal conductivity.

The displacer system 5, which acts as a phase shifter, includes a cylinder 51, a displacer 52 reciprocally fitted in the cylinder 51, a spring 58, a wire coil 59 which is provided around the cylinder 51, and a resister (not shown) connected to the wire coil 59 in series. The spring 58 is connected at its upper end to the cylinder 51 and at its lower end to a back end of the displacer 52. A clearance seal is established between an axial outer surface of the displacer 52 and an inner end wall of the cylinder 51. In the cylinder 51, there are defined a space 53 and a space 54 at opposite ends of the displacer 52.

The displacer 52 is in the form of a permanent magnet and establishes an electromagnetic induction system by cooperating with the coil 59. The displacer system 5 has an eigenfrequency which depends on a mass of the displacer 52 and a spring constant of the spring 58. Induction currents which are generated while the displacer 52 is being in reciprocation movements within the coil 59 are supplied to the resister and an amount of heat is generated or created at the resistor. The resulting heat is rejected or radiated, as Joule heat, to surroundings. Due to such a heat radiation, a damping force is applied to the displacer 52. In addition, another force or compulsory force is applied to displacer 52, whose magnitude is a multiplication of a cross-section area of the displacer 52 and a pressure difference between the space 53 and 54. Thus, the displacer system 5 is constituted or constructed as a damped and compulsory force system.

The pressure difference between the spaces 53 and 54 is due to a pressure loss or drop of the working fluid at the regenerator 2. In detail, when the working fluid moves at its maximum speed within the regenerator 2 from the high temperature end 24 to the low temperature end 23, a value subtracting the value of the pressure in the space 53 from the value of the pressure in the space 54 becomes maximum. To the contrary, when the working fluid moves at its maximum speed within the regenerator 2 from the low temperature end 23 to the high temperature end 24, a value subtracting the value of the pressure in the space 54 from the value of the pressure in the space 53 becomes maximum. The maximum pressure difference is about several percent of the pressure amplitude in the pressure space 53 when the operating frequency of the pressure wave generator 1 is several Hz and is 10~20 percent of the pressure amplitude in the pressure space 53 when the operating frequency of the pressure wave generator 1 is tens of Hz.

In the displacer system 5, if the eigenfrequency thereof is in coincidence with the operating frequency of the pressure wave generator 1, when the displacer 52 which moves at its maximum speed to the high temperature end 44 of the pulse tube 4 passes through the center point of the oscillation of the displacer 52, the absolute value of current induced at the wire coil 59 becomes maximum. Thus, the compulsory force applied to the displacer 52 becomes maximum which is obtained by subtracting the pressure in the space 53 from the pressure in the space 54, and the displacer 52 is brought into oscillation. A maximization of the pressure in the space 53 is established due to a 90 degree phase advance of the pressure oscillation after establishment of maximization of the value which is obtained by subtracting the pressure in the space 53 from the pressure in the space 54. A farthest distance of the displacer 52 relative to the high temperature end 44 of the pulse tube 4 is established due to a 270 degree phase advance of the displacement after the displacer 52, moving toward the high temperature end 44, passes through the center of oscillation at its maximum speed. In brief, there is about 180 degree phase difference between the maximization of the pressure in the space 53 and taking the farthest position of the displacer 52 relative to the high temperature end 44 of the pulse tube 4.

In such a case, at the low temperature end 43 of the pulse tube 4, little very low temperature is produced due to little performance of work by the working fluid. In light of this, in the displacer system 5, the proper frequency is set to be greater than the operating frequency of the pressure wave generator 1 in order to maximize the compulsory force applied to the displacer 52 after the displacer 52 moving toward the high temperature end 44, passes through the center of oscillation of the displacer 52. It is to be noted such a maximization of the compulsory force is established when a value becomes maximum which is obtained by subtracting the value of the pressure in the space 53 from the value of the pressure in space 54. This leads to that a period or time between the maximization of the pressure in the space 54 and subsequent arrival of the farthest position of the displacer 52 relative to the high temperature end 44 of the pulse tube 4 is obtained by subtracting tens of degrees from 180 degrees in time-phase and producing very low temperature at the cold head 3 can be established by setting substantial 90 degree phase difference between the pressure oscillation and the displacement of the working fluid at the low temperature end 43 of the pulse tube 4.

Like the expansion work of the conventional pulse tube refrigeration system 103 as previously discussed, in this displacer system 5 a work Wexp which is rejected to the surroundings from the system 5 can be represented as the following equation.

$$Wexp=\pi A\ p_o\xi_o \sin\Theta$$

where A is a cross-section area of the displacer 52, $p_o$ is an amplitude of the pressure in the space 53, $\xi_o$ is an amplitude of the displacement of the displacer 52, $\Theta$ is the phase difference between the maximum pressure in the space 53 and the farthest position of the displacer 52 relative to the high temperature end 44 of the pulse tube 4 when the displacer 52 is under movement away from the high temperature end 44 of the pulse tube 4.

As long as the foregoing equation is held, a work Wout which is rejected to the surroundings as a heat from the displacer system 5 can be represented approximately as the following formula or equation.

$$Wout=\pi A\ \Delta p_o\xi_o \sin\Theta$$

where Δpo is a differential amplitude between the pressures of the space 53 and 54. In general, the differential amplitude Δpo is about less than 20~30 percent of the amplitude of the pressure variation in the space 53, a ratio of Wout/Wexp can be approximately represented as follows.

$$Wout/Wexp=\Delta po/po<0.2.$$

In accordance with this formula, the work Wout is found to be small enough relative to the work Wexp. This means that most of the work performed by the working fluid at the displacer system 5 can be transmitted via the reciprocating displacer 52 to the connecting tube 14. In light of the fact that most of the work of the working fluid is mechanically converted into the reciprocating movements of the displacer 52 with little loss, the work transmitted to the connecting tube 14 can be used as a part of the work which is to be done by the pressure wave generator 1. Thus, an input work from the pressure wave generator 1 can be decreased and an efficiency of producing very low temperatures can be increased.

Figure 2:
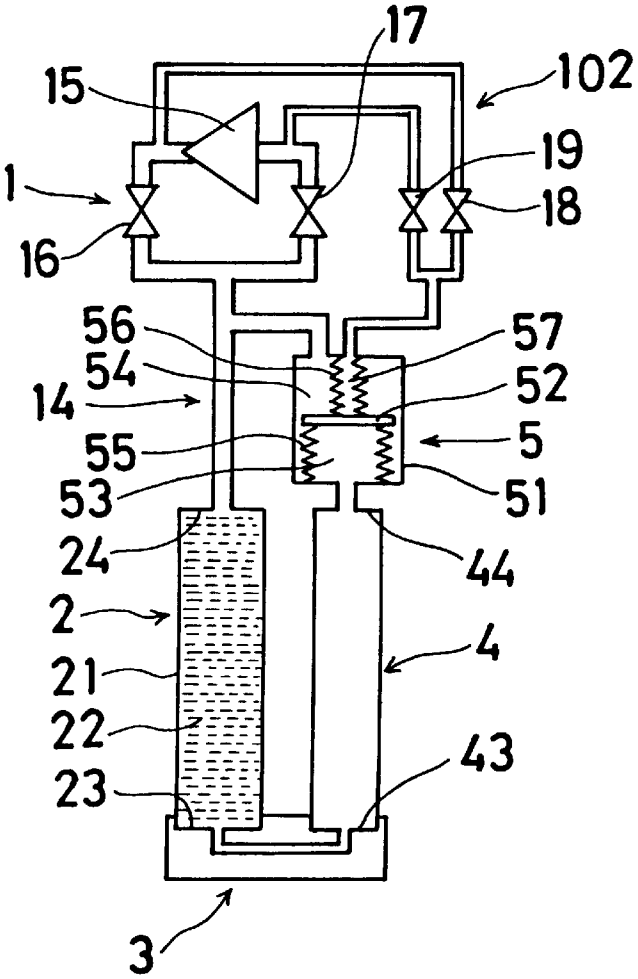
FIG. 2 is a diagram of a second embodiment of a pulse tube refrigeration system according to the present invention.

Referring to FIG. 2 which illustrates a schema of a pulse tube refrigeration system 102 according to a second embodiment of the present invention, the system 102 includes a pressure wave generator 1 and a displacer system 5. The pressure wave generator 1 is constituted by a compressor unit 15 having an exhaust port and a suction port, a high pressure opening/closing valve 16 connected to the exhaust port of the compressor unit 15, and a low pressure opening/closing valve 17 connected to the suction port of the compressor unit 15.

The displacer system 5 has a cylinder 51 in which a displacer 52 is disposed. A bellows 55 is interposed between a bottom of the cylinder 51 and a lower surface of the displacer 52 and a space 53 is defined in the bellows 55 which is in fluid communication with a high temperature end 44 of a pulse tube 4. A bellows 56 which is smaller than the bellows 55 in radius is interposed between an upper surface of the displacer 52 and a top of the cylinder 51. Between the bellows 56 and the cylinder 51, there is defined a space 54 which is in fluid communication with the connecting portion 14. Within the bellows 56, a space 57 is defined which is connected to a high pressure opening/closing valve 18 and a low pressure opening/closing valve 19 which are connected to the exhaust port and the suction port of the compressor unit 15, respectively. Other structures in the pulse tube refrigeration system 102 is similar to the corresponding ones in the pulse tube refrigeration system 101 and therefore further explanations related to the former are omitted.

As previously discussed in the foregoing pulse tube refrigeration system 101, the pressure drop in the regenerator 2 is employed as the compulsory force to be applied as a pressure differential across displacer 52. In the pulse tube refrigeration system 102, instead of only using the pressure drop in the regenerator to cause a pressure differential across the displacer 52, a pressure difference between the suction port and the discharge port of the compressor unit 15 is also used.

In the pulse tube refrigeration system 102, a pressure oscillation of the working fluid is caused by alternating openings of the high pressure opening/closing valve 16 and the low pressure opening/closing valves 17. The displacer 52 is brought into movement toward the high temperature end 44 of the pulse tube 4 by opening the high temperature opening/closing valve 18 and after passing of tens of degrees in phase-time the high pressure opening/closing valve 16 is opened. The high pressure opening/closing valve 18 is closed and after passing of tens of degrees in phase-time the high pressure opening/closing valve 16 is closed. The displacer 52 is brought into movement away from the high temperature end 44 of the pulse tube 4 by opening the low pressure opening/closing valve 19 and after passing of tens of degrees in phase-time the low pressure opening/closing valve 17 is opened. The low pressure opening/closing valve 19 is closed and after passing of tens of degrees in phase-time the low temperature opening/closing valve 17 is closed. By repeating the foregoing sequential valve actions, it becomes possible to set a substantial 90 degree phase difference between the pressure oscillation and the displacement of the working fluid at the low temperature end 43 of the pulse tube 4. Thus, a cooling ability or capacity at the cold head 3 is increased and thereby an expected very low temperature can be produced at the cold head 3.

In addition, in the displacer system 5, setting the radius of the bellows 56 smaller than the radius of the bellows 55 lessens the work done on the working fluid in the space 57 by the displacer 52 relative to the expansion work of the working fluid in the displacer system 5. This means that most of the work performed by the working fluid at the displacer system 5 can be transmitted via the reciprocating displacer 52 to the connecting tube 14. In light of the fact that most of the work of the working fluid is mechanically converted into the reciprocating movements of the displacer 52 with little loss, the work transmitted to the connecting tube 14 can be used as a part of the work which is to be done by the pressure wave generator 1. Thus, an input work from the pressure wave generator 1 can be decreased and an efficiency of producing very low temperature can be increased.

Though detailed explanations are omitted, it should be read that obviously the space 53 is separated, in fluid flow, from either the space 54 or the space 56.

It is to be noted that the present invention is not restricted to the foregoing embodiments. Thus, for example, the concept of the present invention can be easily applied to a pulse tube refrigerate two or more cold heads. In addition, such a concept can be used in parallel with the conventional phase shifter.

The invention has thus been shown and described with reference to specific embodiments, however, it should be noted that the invention is in no way limited to the details of the illustrated structures but changes and modifications may be made without departing from the scope of the appended claims.

What is claimed as new and is desired to be secured by Letters Patent of the United States is:

1. A pulse tube refrigeration system comprising:

a pressure wave generator continuously generating pressure oscillations wave in a working fluid;

a regenerator having a low temperature end and a high temperature end, said high temperature end connected to said pressure wave generator;

a cold head having a first and a second end, said first end connected to said low temperature end of said regenerator;

a pulse tube having a high temperature end and a low temperature end, said low temperature end of said pulse tube connected to said second end of said cold head, and a phase shifter having a first and second end, said first end of said phase shifter connected to said high temperature end of said pulse tube, said second end of said phase shifter connected to said high temperature end of said regenerator such that said phase shifter adjusts a phase difference between a pressure oscillation and a displacement of the working fluid and said phase shifter transmits an expansion work of the working fluid to said high temperature end of said regenerator in mechanical mode which is produced at said high temperature end of said pulse tube.

2. A pulse tube refrigeration system comprising:

a pressure wave generator generating continuous pressure wave of a working fluid;

a regenerator having a low temperature end and a high temperature end connected to the pressure wave generator;

a cold head connected at a first end thereof to the low temperature end of the regenerator;

a pulse tube having a high temperature end and a low temperature end connected to the a second end of the cold head; and a displacer unit interposed between the high temperature end of the pulse tube and the high temperature end of the regenerator for adjusting a phase difference between an oscillation and a displacement of the working fluid and transmitting an expansion work of the working fluid to the high temperature end of the regenerator in mechanical mode which is produced at the high temperature end of the pulse tube.

3. A pulse tube refrigeration system in accordance with claim 2, wherein the pressure wave generator and the high temperature end of the regenerator are connected by a connecting tube, a first end of said displacer unit is connected to the high temperature end of the pulse tube and a second end of said displacer unit is connected to said connecting tube.

4. A pulse tube refrigeration system in accordance with claim 2, wherein the displacer unit includes a cylinder, a displacer reciprocally fitted in the cylinder and defining therein a first space connected to the high temperature end of the pulse tube and a second space connected to the high temperature end of the regenerator, and a spring supporting the displacer in the cylinder.

5. A pulse tube refrigeration system in accordance with claim 4, wherein the displacer is made of a permanent magnet and a wire coil is provided around the cylinder.

6. A pulse tube refrigeration system in accordance with claim 4, wherein a compulsory force is applied to said displacer wherein the compulsory force is caused by a pressure difference between the first space and the second space which is due to a pressure drop of the working fluid in the regenerator, the displacer is additionally applied with a damping force caused by induced currents to be radiated to surroundings as a Joule heat which are created during reciprocal movements of the displacer due to the compulsory force applied thereto.

7. A pulse tube refrigeration system in accordance with claim 6, wherein a phase difference between the pressure oscillation and the displacement of the working fluid is established to be approximately 90 degrees at the low temperature end of the pulse tube by setting an eigenfrequency of the displacer unit greater than a frequency of the working fluid which is determined by the pressure wave generator.

8. A pulse tube refrigeration system in accordance with claim 2, wherein the pressure wave generator includes a cylinder and a piston reciprocally fitted therein.

9. A pulse tube refrigeration system in accordance with claim 2, wherein the pressure wave generator includes a compressor having a suction and an exhaust port, a first high pressure opening/closing valve connected to the exhaust port, and a first low pressure opening/closing valve connected to the suction port.

10. A pulse tube refrigeration system in accordance with claim 9, wherein the displacer unit includes a cylinder, a displacer reciprocally fitted in the cylinder, a second high pressure opening/closing valve connected to the exhaust port of the compressor, a second low pressure opening/closing valve connected to the suction port of the compressor, a first bellows connected at one end and the other end thereof to one end of the displacer and the high temperature end of the pulse tube, respectively, the first bellows defining therein an inner space which is in sealed fluid communication with the high temperature end of the pulse tube, a second bellows connected to the other end of the displacer, the second bellows defining therein an inner space which is in sealed fluid communication with the second high pressure opening/closing valve and the second low temperature opening/closing valve, and a third space defined between the cylinder and both of the first bellows and the second bellows and being in fluid communication with the high temperature end of the regenerator.

11. A pulse tube refrigeration system in accordance with claim 10, wherein a differential pressure is caused between the inner spaces of the first bellows and the second bellows by alternating opening and closing of the second high pressure opening/closing valve and the second low pressure opening/closing valve, the resultant differential pressure constitutes a part of a compulsory force applied to the displacer.

12. A pulse tube refrigeration system in accordance with claim 11, wherein a phase difference of the pressure oscillation and the displacement of the working fluid is set to be approximately 90 degrees by differentiating the first high pressure opening/closing valve from the second high pressure opening/closing valve in opening time and by differentiating the first low pressure opening/closing valve from the second low pressure opening/closing valve in opening time.

* * * * *